United States Patent [19]

Cohen et al.

[11] Patent Number: 4,907,609

[45] Date of Patent: Mar. 13, 1990

[54] METHOD OF INCREASING THE HARDNESS OF CIGARETTE FILTER ELEMENTS

[75] Inventors: Richmond R. Cohen, Hockessin; Jimmie D. McCarty, Arden, both of Del.

[73] Assignee: Hercules Incorporated, Wilmington, Del.

[21] Appl. No.: 236,477

[22] Filed: Aug. 24, 1988

[51] Int. Cl.[4] ..... A24D 3/08; A24D 3/10; A24D 3/12

[52] U.S. Cl. ..... 131/332; 131/334; 131/343

[58] Field of Search ..... 131/331, 345, 343, 332, 131/334

[56] References Cited

U.S. PATENT DOCUMENTS 3,635,226 1/1972 Horsewell et al. .
4,022,223 5/1977 Rainer et al. .
4,756,316 7/1988 Keritsis et al. .

*Primary Examiner*—V. Millin
*Attorney, Agent, or Firm*—John E. Crowe

[57] ABSTRACT

Filter element and method for increasing the hardness thereof by contacting filter plug material with effective amounts of (a) a water soluble resin (or copolymer) having available chelate bond-forming chemical groups and (b) a water soluble nontoxic salt, the metal cation of the nontoxic salt forming a chelate bond with the chelate bond-forming chemical groups of said water soluble resin.

25 Claims, 2 Drawing Sheets

METHOD OF INCREASING THE HARDNESS OF CIGARETTE FILTER ELEMENTS

The present invention relates to cigarette filter elements and a method for increasing the hardness thereof by incorporating water soluble metal chelate-forming components therein.

BACKGROUND

Although fiber-based cigarette filter elements are well known and have been used commercially for a number of years, the available choice of substrate components to form such filters has remained quite narrow, due to functional and cost factors, particularly the lack of suitability of many natural fibers for high speed production using a state-of-the art filter rod-making apparatus. In addition, functional demands on modern commercial cigarette filters tend to conflict with respect to various characteristics such as general and selective filtration efficiency, ease in handling, filter draw properties, and particularly filter element hardness.

For such reasons a substantial number of cigarette filter elements continue to be produced by use of old technology designed for handling cellulose acetate-based fiber.

Cellulose acetate fiber tow can be readily processed into cuttable filter rods using essentially unmodified state-of-the-art filter rod-making devices without serious jamming problems. This advantage is enjoyed despite present day need for a substantial number of additives such as, non-volatile organic plasticizers, inclusive of triacetin, diacetin, and citric acid, lubricants, flavors, medicines, selective filtering agents and the like. Such additives are most conveniently applied in the form of aqueous solutions onto opened fiber tow by conventional dipping, spraying, printing and the like. In the case of plasticizer additives, the resulting softened areas are capable of randomly adhering to adjacent fiber. This, in combination with crimp, is used to impart some degree of rigidity or hardness to the corresponding filter rod. Such treatment, in turn, permits further processing such as a rod-cutting step, to obtain desired filter element lengths.

The above-stated advantages of cellulose acetate fiber, however, are countered by serious disadvantages. For example the cellulose-based fiber tends to be relatively weak compared with synthetics such as polyolefin fiber. This characteristic seriously limits the amount of tension and crimp which can be imparted to filter-efficient low dpf fiber tow at production speeds, thereby requiring use of higher denier and reduced filter efficiency.

Synthetic fiber of filament components, particularly polyolefins such as polypropylene staple, on the other hand, offer a cheaper viable alternative since they can be drawn to a relatively small denier favoring a higher general filter efficiency without loss in tensile strength.

Synthetic fiber such as polyolefins, unfortunately, also have disadvantages. These generally relate to their chemically inert hydrophobic nature and the fact that a majority of known cigarette filter additives tend to be hydrophilic and difficult to apply and retain in functionally active mounts within a hydrophobic-type substrate or filter element.

Another substantial problem, unique to the cigarette filter art, concerns the difficulty in optimizing dimensional stability, hardness and draw of both cellulose acetate and synthetic fiber-containing cigarette filters without substantial cost increase due to required additional processing, higher substrate content and the like. In addition polyolefin-containing filter elements often demonstrate a significant correlation between draw (i.e. pressure drop) and hardness properties within cigarette filter elements. Furthermore, it is found difficult to avoid jamming of heavily impregnated substrate fed at high speed as garniture feed into a conventional filter rod-making apparatus, particularly when required additives must be dispersed in viscous carriers or vehicles.

It is an object of the present invention to more easily control the hardness properties of cigarette filter elements.

It is a further object to increase the hardness of cigarette filter elements without substantially increasing crimp, substrate concentration, or denier within the filter plug.

THE INVENTION

The above objects are obtained in accordance with the present invention for increasing hardness of cigarette filter elements comprised of substrate in the form of at least one of an open fiber tow, a sliver, a ribbon of a nonwoven material, and fibrillated film by (A) contacting the substrate with effective amounts of (a) a water soluble resin component having available chelate-bond-forming groups and (b) a nontoxic metal salt component, including water soluble and insoluble salts or mixtures thereof, the corresponding metal cation of which forms a chelate bond with chelate bond-forming groups of said water soluble resin component; and (B) completing fabrication of the desired filter element.

The term "contacting the substrate" as used herein denotes applying water soluble (a) resin and (b) water soluble or insoluble salt components individually or in combined solution or as suspensions onto fiber- or film-containing substrate suitable for forming filter rods on a conventional cigarette filter rod-making apparatus. Such substrate includes one or more of the above-listed types of garniture feed introduced as web(s), tow(s) fibrillated film(s) or a plurality thereof in complete or partial register (ref. FIGS. 1–3 below).

For present purposes the term "substrate" is here defined to cover garniture feed usable in a conventional filter rod-making apparatus comprising a tow trumpet, garniture, shaping means, wrapping means, and cutting means in accordance with components and processes generally described, for instance, in U.S. Pat. No. 3,144,023 and U.S. Pat. No. 2,794,480. If desired, however, modifications in filter rod-making apparatus can be utilized to permit in-situ spraying (ref. FIGS. 1–3), dipping (ref. FIG. 4), printing (not shown), or even vacuum draw into a fiber tow, sliver and the like prior to or after formation of a filter plug.

By way of further embodiments, baled sliver nonwoven strips can be dip coated or feedably contacted by one or more printing roll(s) using separate reservoir(S) or a single reservoir containing mixed solutions of the desired active chelating component(s), followed by conventional drying steps using nip rolls, heated drying rolls, ovens, and the like; such step preferably occurs at relatively low temperatures within a range of about 20° C.–80° C.

It is also found suitable, to use ribbons of one or more nonwoven fabrics formed of the same or a mixture of fiber compositions and deniers. Such arrangement is found particularly useful when not all of the substrate used to form the filter element is to be a carrier surface for the chelating or other more conventional filter-modifier component(s) (ref. FIG. 3)

For present purposes substrates suitable as garniture feed components can comprise up to about 100% and preferably 10%–100% by weight of polyolefin (mono-, bi-, or tri-component) fiber identified generally as polyolefin fiber, and may also comprise webs, slivers and nonwovens as above noted, having filaments of homogeneous or mixed denier, including combinations of components such as (a) polypropylene/polyethylene, polypropylene/polyvinylidene chloride, polypropylene/cellulose acetate, polypropylene/rayon, polypropylene/nylon, cellulose acetate/polyethylene, plasticized cellulose acetate, polypropylene/paper; or (b) polypropylene/polystyrene/polyethylene, and the like, in preferred ratios of about (a) 10%–90%/90%–10% or (b) 10%–90%/45%–5%/45%–5% based on dry substrate weight, and as generally described, for instance, in U.S. Pat. No. 3,393,685.

The term "effective amounts" for purposes of the present invention denotes the use of about 0.5%–5% by weight of the (a) water soluble resin or polymer (based on dry substrate) component, and sufficient (b) salt component to obtain a ratio by weight of resin-to-salt of about 2–3:2–5 and preferably about 3% (a) resin in a 3:5 ratio by weight of resin-to-salt.

For purposes of the present invention, the term "water soluble resin component" is defined as a nontoxic water soluble resin or polymer which is capable of providing an electron pair donated, for instance, by a nitrogen, oxygen, carbonyl or sulfur-containing chemical group (ref. Fieser and Fieser Advanced Organic Chemistry 1965 pages 408, 718, 827) capable of forming a chelate complex in the presence of a nontoxic metal salt. Suitable resin components include, for instance, polyimine, polyamine, polyamide, polythiol, polycarboxylate and polyether configurations. Of particular interest in this regard are polyethyleneimine (PEI)*1, polyethylene glycol (PEG) and a cationic water soluble condensate of a basic polyamide and epichlorohydrin*2 as the "a" chelating component.

*1Obtainable commercially from BASF as Polymin-P *2Obtainable commercially from Hercules Incorporated as Kymene 557, 525, 2064 resins.

For present purposes such resin components can usefully vary from about 1,000–50,000 in molecular weight (wt average), the lower range favoring a lower viscosity and easier pumping.

If desired, the substrate to which the above polymeric component(s) is/are added can also contain, or be treated with, an intermediate such as maleic anhydride or the like to improve adhesion characteristics.

The (b) or "nontoxic metal salt component" of the present invention utilizes metals which fall within the definition of "transition elements" and also "alkaline earth metals", preferably alkali metals and cation-forming metal within the group consisting of zinc, gold, platinum, manganese, potassium, calcium and barium in combination with chemically compatible anionic groups such as sulfate, carbonate, phosphate, chloride, bromide, propionate and thiocyanate groups.

Generally speaking such components react under relatively mild temperature conditions when applied to a substrate of the present invention.

Also within the scope of the present invention are substrates containing surfactant material as a supplemental additive, generally, in concentrations of about 0.1%–10% and preferably about 0.5%–10% by weight of one or more of a class examplified as (1) a polyoxyalkylene derivative of a sorbitan fatty acid ester, (2) a fatty acid monoester of a polyhydroxy alcohol, or (3) a fatty acid diester of a polyhydroxy alcohol.

Suitable surfactants for such purpose can include, for instance, ethoxylates, carboxylic acid esters, glycerol esters, polyoxyethylene esters, anhydrosorbitol esters, ethoxylated anhydrosorbitol esters, ethoxylated natural fats, oils and waxes, glycol esters of fatty acids, polyoxyethylene fatty acid amides, polyalkylene oxide block copolymers, and poly(oxyethylene-co-oxypropylene).

Additional additives can also be employed such as solutions, emulsions, suspensions or dispersions of humectants generally exemplified by polyhydric alcohols such as glycerols, glycols, etc.; flavors and perfumes such as ketoses and polysaccharides, including wintergreen, spearmint, peppermint, chocolate, licorice, cinnamon, fruit flavors, citrus et., and additives as otherwise found in U.S. Pat. Nos. 4,485,828 and 4,715,390; medicines, and as menthol and decongestants, and the like.

In order to maintain precise control over additives, however, it is found useful if each substrate is controlled with respect to moisture content before conversion into filter elements for testing. In addition, a filter element and its active additive components can be further isolated or shielded from direct contact with the lips by applying the active component onto a tow, sliver or nonwoven fabric which is, in turn, can be sandwiched within two or more untreated nonwoven fabrics of lesser permeability (Ref. FIG. 3).

Completion of fabrication of filter elements within, the present invention is usefully carried out by use of a conventional filter rod making devise comprising a garniture trumpet, garniture, shaping means, wrapping means, and cutting means in accordance with components and processes generally described, for instance, in U.S. Pat. No. 3,144,023 and U.S. Pat. No. 2,794,480 and in general accordance with FIGS. 1–4 below. If desired, however, and in accordance with the present invention, structural modifications can be made to permit in-situ or prior spraying, dipping, printing, vacuum draw, or other traditional application methods for introducing one or more modifier components of the present invention or other conventional additives prior to or after the formation of a filter plug.

For present purposes, both treated and combinations of treated and untreated fabric ribbon, tow, and the like can be usefully wrapped using film or a regular plug wrap paper having a weight conveniently within a range of about 25–90 g/m$^2$ or higher, as desired.

BRIEF DESCRIPTION OF THE DRAWINGS

Fabrication of filter elements by use of the instant invention is further illustrated in FIGS. 1–4, wherein FIG. 1 diagrammatically represents a conventional cigarette filter rod-making apparatus capable of converting substrates, treated as above described, into filter elements having improved hardness.

DETAILED DESCRIPTION OF THE DRAWINGS

Figure 1:
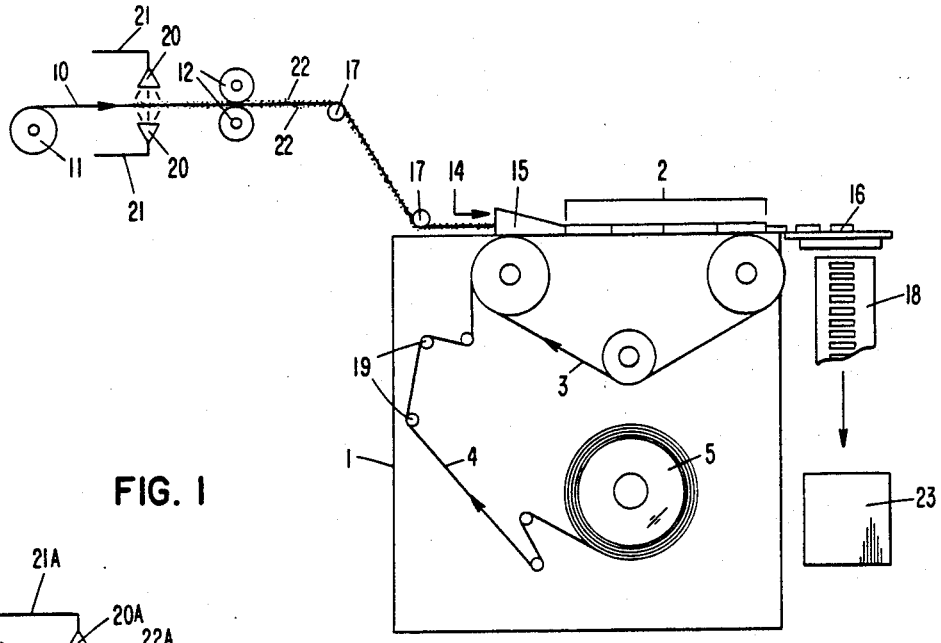

Referring to FIG. 1, in further detail, a single continuous substrate such as opened fiber tow, a sliver, fibrillated film or ribbon of nonwoven fabric (10) is fed from feed reel (11) or a bale (not shown) and run beneath two spray heads (20) feedably connected to feed lines from outside sources (not shown) to respectively apply mixture(s) of active chelating components and other additives, as desired, to both sides of the substrate (22). The treated substrate is then dried by air drying means (not shown) and/or by passing through drying rolls (12), to obtain a desired degree of dryness, and then led by guide rolls (17) into a garniture trumpet (15) and garniture (14) of a cigarette filter rod manufacturing apparatus (1), comprised of a garniture section (2) including (but not showing) means for shaping and retaining the substrate feed, wrapping means, and cutting means for converting the wrapped plug or rod into filter element (16); the wrapping means is conveniently supplied with tow wrap such as paper or film from wrap feed reel (5), supported by support rolls (19), and moved onto a continuous garniture belt (3) for introduction into the garniture of the rod-making apparatus.

The apparatus, as described, utilizes conventional means for sealing tow wrap around a formed filter tow plug (not shown), the wrapped tow plug then being cut by cutting means into generally cylindrical filter elements (16) of desired length, which are removed through filter chute (18) (shown in fragment) for packing in container (23).

Figure 2:
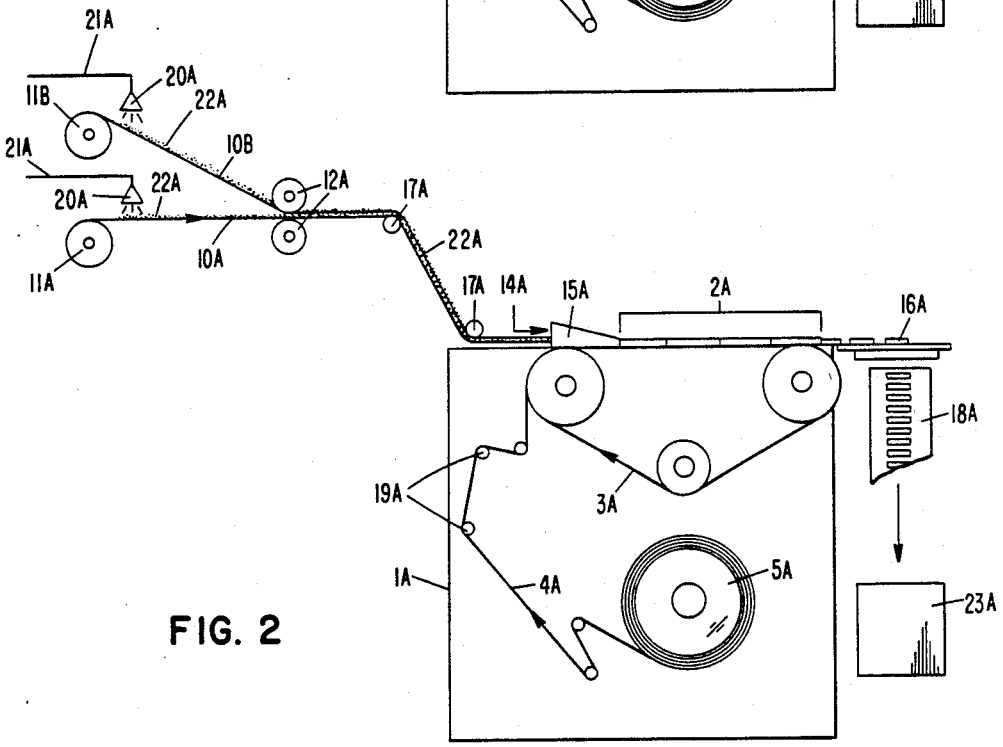
FIGS. 2–4 diagrammatically represent further modifications in processing, whereby one or more tow, sliver, ribbon of nonwovens, and fibrillated film are treated with one or more substrate modifier components or mixtures thereof, as above described, by spraying, dipping, or otherwise, the use of multiple substrates in combination with active amounts of "a" and "b" chelating components favoring filter element bulk, (where desired) and significantly improved filter crush resistance or hardness.

FIG. 2 diagrammatically demonstrates a modified arrangement for separately applying mixtures of active chelating component(s) onto two separate substrates (10A) (10B) using spray heads (20A) fed by corresponding interconnected feed lines (21A), to apply effective amounts of mixed chelating components (22A), which are then dried, using air and heated rolls (12A), before being fed through garniture (14A) of rod-making apparatus (1A) to form filter elements (16A) as before. Substrates (10A and 10B) are fed respectively from feed rolls (11A) and (11B) or bales (not shown) and brought into register at heated nip rolls (12A), then guided by guide rolls (17A) into garniture (14A), the garniture feed or substrate components shown being similarly defined by arabic numbers in each of FIGS. 1–4.

Figure 3:
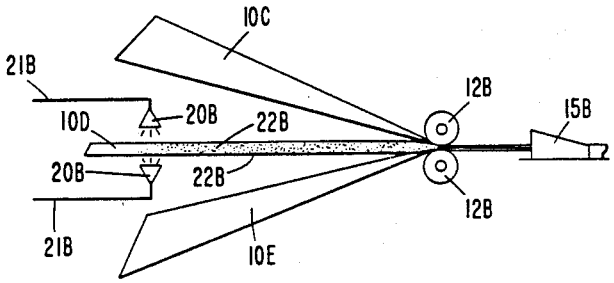

FIG. 3 diagrammatically demonstrates a further modification of the equipment and process of FIGS. 1 and 2, whereby several substrates of the same or different types (10C, 10D, and 10E), as described above, from reels or boxes (not shown) are fed through a nip created by heated rolls (12B), the middle substrate (10D) preferably being of different width and having higher absorption or adsorption properties for retaining premixed chelating component(s) (22B) than the two external untreated substrates (10C and 10E). As shown, substrate (10D) is sprayed on both sides with premixed chelating components (a) and (b) and any desired compatible conventional optional additives (22B) using spray heads (20B) fed from feed lines (21B), one substrate (10E) preferably being arranged so as to catch surplus drip or misdirected active components not retained or captured by ribbon (10D), all three substrates are then air dried by passing in register through heated nip rolls (12B), as before, and directed by guide rolls (not shown) into the garniture of a filter rod apparatus in the manner of FIGS. 1 and 2.

Figure 4:
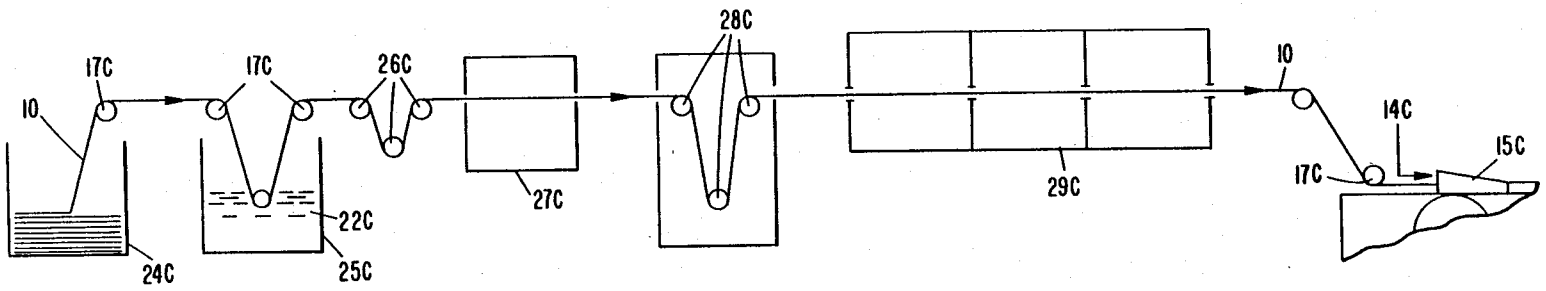

FIG. 4 is a diagrammatic representation of a further process modification in which one or more substrate(s) (shown as 10C) is separately fed from a bale or box (24C), passed over guide rolls (17C), and dipped into a reservoir (25C) containing active chelating component(s) (22C) in solution, suspension, or emulsion, and then passed through rolls (26C), through a heating oven (27C), drawer rolls (28C), a three step drying oven (29C), and then to garniture (14C) of a cigarette rod manufacturing apparatus in the manner of FIGS. 1–3, supra, or separately boxed and stored (not shown) for future use.

Where a continuous fiber tow is used as a substrate component, preparation of the tow is conveniently carried out in the usual way by drawing the fiber from one or more creels through a fluid bulking or texturing jet (not shown in figures) and then handled as described above.

Substrates which are treated in accordance with the present invention can usefully comprise a variety of filaments. Thus, it is possible to use cellulose acetate, polyesters, polyamides, acrylics, as well as polyolefins and the like. Due to its relatively low density, compared to other synthetic fiber-forming material and excellent spin properties, combinations of filament-forming copolymers of propylene with ethylene or other lower olefin monomers are particularly preferred as tow, nonwoven ribbon and fibrillated film material.

The bulk denier of a tow for carrying out the present invention can conveniently fall between about 2,000 and 10,000, and this substrate can be supplied as a crimped fiber from a single creel or bale, or a composite of several creels or bales combined and passed through a fluid jet simultaneously. For best performance of fiber tow as cigarette filters, however, it is preferred that at least some tow be substantially untwisted and untexturized prior to entering a fluid jet.

The invention is further illustrated by the following Examples.

EXAMPLE 1

Baled 4.5 dpf (av.) round unsized polypropylene fiber obtained from melt spun isotactic polypropylene having a flow rate of 35.2 gm/10 minutes, is broken, opened, carded, crimped and pulled to form a thin tow ribbon about 12–14 inches in width. The ribbon is sprayed with sufficient combined aqueous solution containing 3% polyethyleneimine and 5% zinc thiocyanate, to obtain a ratio by dry weight of about 3:5, air dried, and passed through the garniture of a filter rod making apparatus (model PM-2 Mollins Ltd.), using paper plug tow wrap.*3 The filter rod-making apparatus is adjustable to obtain high (MAX), medium (MED) and low (MIN) fiber content, and the resulting filter rods individually tested for firmness using a standard Filtrona Digital Hardness Tester DHT 200. The results are reported in Table 1 as S1-S3 in comparison with corresponding untreated controls C1-C3.

*3. 38 gm/M

TABLE 1

| SAMPLE | ROD WT RANGE | FIRMNESS (% F. av) |
|---|---|---|
| S1 | MIN | 85.28 |
| C1 | MIN | 81.54 |

TABLE 1-continued

| SAMPLE | ROD WT RANGE | FIRMNESS (% F. av) |
|---|---|---|
| S2 | MID | 88.78 |
| C2 | MID | 86.72 |
| S3 | MAX | 91.94 |
| C3 | MAX | 89.14 |

EXAMPLE 2

A. Baled 4.5 dpf round cross section unsized polypropylene fiber obtained from melt spun isotactic polypropylene having a flow rate of 35.2 gm/10 minutes, is broken, opened, carded, crimped and pulled to form a thin tow ribbon about 12–14 inches in width. The ribbon is drawn, without further treatment, through the garniture of a conventional filter rod-forming apparatus, identified as model PM-2 obtained from Mollins Ltd. of Great Britain, at a constant setting to form 135 mm filter rods wrapped with BXT-100 polypropylene film. The rods are cut into 27 mm test filter element lengths, which are graded and sorted to obtain substantially equal weight, and draw*5 and set aside for testing and control purposes.

*5 Within the range of 111–136 mm Wg (water gauge)

B. Seventy-two (72) weighed test filters obtained as described in Example 2A are endwise inserted into hollow fitted plastic inserts connected by Tygon*6 tubing respectively to a rubber bulb and to a desired reservoir of mixed aqueous solution of (a) resin and (b) salt component. Test solution is drawn up through individual test filters until flow through is observed, each filter is then disconnected and oven dried for 24 hours at 40°–50° C., cooled, reweighed, and the tested for hardness, using a Filtrona Digital Hardness Tester (Model DHT 200). The aqueous test solution(s) employed are varied with respect to concentration and type of "a" chelate forming resin and concentration and type of "b" chelate-forming salt. Test results and controls (C numbers) are reported in Table 2 below.

TABLE 2

| Sample | Resin(a) | Resin % by wt | Salt(b) | Salt % by wt | Hardness % F. (av) |
|---|---|---|---|---|---|
| S4 | Kymene ® 7 557H | 1% | $ZnSO_4$ | 1.6% | 81.2 |
| C4 | — | — | — | — | 84.4 |
| S5 | Kymene 557H | 3% | $ZnSO_4$ | 5% | 89.3 |
| C5 | — | — | — | — | 84.3 |
| S6 | Kymene 367 | 1% | $ZnSO_4$ | 1.6% | 84.6 |
| C4 | — | — | — | — | 84.4 |
| S7 | Kymene 367 | 3% | $ZnSO_4$ | 5% | 88.2 |
| C5 | — | — | — | — | 84.3 |
| S8 | Kymene 2064 | 1% | $ZnSO_4$ | 1.6% | 84.0 |
| C4 | — | — | — | — | 84.4 |
| S9 | Kymene 2064 | 3% | $ZnSO_4$ | 5% | 92.2 |
| C5 | — | — | — | — | 84.3 |
| S10 | Kymene 45D | 1% | $ZnSO_4$ | 1.6% | 83.6 |
| C4 | — | — | — | — | 84.4 |
| S11 | Kymene 45D | 3% | $ZnSO_4$ | 5% | 90.7 |
| C5 | — | — | — | — | 84.3 |
| S12 | PEI*8 | 1% | $ZnSO_4$ | 1.6% | 84.2 |
| C4 | — | — | — | — | 84.4 |
| S13 | PEI | 3% | $ZnSO_4$ | 5% | 94.4 |
| C5 | — | — | — | — | 84.3 |

*7A commercial water soluble cationic resin product of Hercules Incorporated
*8Polyethyleneimine C. Example 2B is repeated but using aqueous solutions of PEI resin in a 2–3% range and zinc sulfate in a 3:5 ratio by weight. Test results are reported in Table 3.

D. Example 2B is repeated using aqueous solutions within a 1%–3% PEI range and magnesium or sodium sulfate in a constant 3:5 ratio by weight. Test results are reported in Table 4.

TABLE 3

| Sample | Resin(a) | Resin (% by wt) | Salt(b) | Salt (% by wt) | Hardness % F. (av) |
|---|---|---|---|---|---|
| S14 | PEI | 1 | $ZnSO_4$ | 1.6 | 86.4 |
| C14 | — | — | — | — | 85.6 |
| S15 | PEI | 1.5 | $ZnSO_4$ | 2.5 | 85.6 |
| C14 | — | — | — | — | 85.6 |
| S16 | PEI | 2 | $ZnSO_4$ | 3.3 | 90.8 |
| C14 | — | — | — | — | 85.6 |
| S17 | PEI | 2.5 | $ZnSO_4$ | 4.2 | 90.1 |
| C14 | — | — | — | — | 85.6 |
| S18 | PEI | 3 | $ZnSO_4$ | 5 | 90.4 |
| C14 | — | — | — | — | 85.6 |
| S19 | PEI | 2 | $ZnSO_4$ | 1 | 85.8 |
| C15 | — | — | — | — | 86.8 |
| S20 | PEI | 2 | $ZnSO_4$ | 2 | 87.0 |
| C15 | — | — | — | — | 86.8 |
| S21 | PEI | 2 | $ZnSO4_4$ | 3 | 88.1 |
| C15 | — | — | — | — | 86.8 |
| S22 | PEI | 2 | $ZnSO_4$ | 4 | 89.3 |
| C15 | — | — | — | — | 86.8 |
| S23 | PEI | 2 | $ZnSO_4$ | 5 | 87.9 |
| C15 | — | — | — | — | 86.8 |

TABLE 4

| Sample | Resin(a) | Resin (% by wt) | Salt(b) | Salt (% by wt) | Hardness % F. (av) |
|---|---|---|---|---|---|
| S24 | PEI | 1 | $MgSO_4$ | 1.6 | 86.9 |
| C16 | — | — | — | — | 85.8 |
| S25 | PEI | 1.5 | $MgSO_4$ | 2.5 | 89.1 |
| C16 | — | — | — | — | 85.8 |
| S26 | PEI | 2 | $MgSO_4$ | 3.3 | 88.8 |
| C16 | — | — | — | — | 85.8 |
| S27 | PEI | 2.5 | $MgSO_4$ | 4.2 | 89.5 |
| C16 | — | — | — | — | 85.8 |
| S28 | PEI | 3 | $MgSO_4$ | 5 | 91.1 |
| C16 | — | — | — | — | 85.8 |
| S29 | PEI | 1 | $Na_2SO_4$ | 1.6 | 86.5 |
| C16 | — | — | — | — | 85.8 |
| S30 | PEI | 1.5 | $Na_2SO_4$ | 2.5 | 87.8 |
| C16 | — | — | — | — | 85.8 |
| S31 | PEI | 2 | $Na_2SO_4$ | 3.3 | 87.8 |
| C16 | — | — | — | — | 85.8 |
| S32 | PEI | 2.5 | $Na_2SO_4$ | 4.2 | 90.0 |
| C16 | — | — | — | — | 85.8 |
| S33 | PEI | 3 | $Na_2SO_4$ | 5 | 91.2 |
| C16 | — | — | — | — | 85.8 |

E. Example 2B is repeated but using aqueous solutions containing, respectively, PEI, Kymene 557, 367, a 1:1 copolymer of methyl vinyl ether/maleic anhydride (MVE/MA), or carboxymethylcellulose (CMC) as the "a" component is combined with magnesium sulfate or zinc sulfate as the "b" component. The resulting treated filters are tested as before and the test results are reported in Table 5 below.

TABLE 5

| Sample | Resin(a) | Resin (% by wt) | Salt(b) | Salt (% by wt) | Hardness % F. (av) |
|---|---|---|---|---|---|
| S34 | PEI | 2 | $MgSO_4$ | 3.3 | 94.9 |
| C17 | — | — | — | — | 87.2 |
| S35 | Kymene 557 | 2 | $MgSO_4$ | 3.3 | 94.5 |
| C17 | — | — | — | — | 87.2 |
| S36 | Kymene 367 | 2 | $MgSO_4$ | 3.3 | 94.2 |
| C17 | — | — | — | — | 87.2 |
| S37 | MVE/MA | 2 | $MgSO_4$ | 3.3 | 96.8 |
| C17 | — | — | — | — | 87.2 |
| S38 | PVP | 2 | $MgSO_4$ | 3.3 | 95.4 |
| C17 | — | — | — | — | 87.2 |
| S39 | CMC | 2 | $MgSO_4$ | 3.3 | 96.4 |
| C17 | — | — | — | — | 87.2 |
| S40 | PEI | 2 | $ZnSO_4$ | 3.3 | 86.8 |
| C17 | — | — | — | — | 87.2 |

TABLE 5-continued

| Sample | Resin(a) | Resin (% by wt) | Salt(b) | Salt (% by wt) | Hardness % F. (av) |
|---|---|---|---|---|---|
| S41 | Kymene 557 | 2 | $ZnSO_4$ | 3.3 | 87.4 |
| C17 | — | — | — | — | 87.2 |
| S42 | Kymene 367 | 2 | $ZnSO_4$ | 3.3 | 90.6 |
| C17 | — | — | — | — | 87.2 |
| S43 | MVE/MA | 2 | $ZnSO_4$ | 3.3 | 93.6 |
| C17 | — | — | — | — | 87.2 |
| S43 | PVP | 2 | $ZnSO_4$ | 3.3 | 94.7 |
| C17 | — | — | — | — | 87.2 |
| S44 | CMC | 2 | $ZnSO_4$ | 3.3 | 90.3 |
| C17 | — | — | — | — | 87.2 |

We claim:

1. A method for increasing hardness of cigarette filter elements obtained from substrate in the form of at least one of an open fiber tow, a sliver, a ribbon of nonwoven material, and fibrillated film, comprising (A) contacting polyolefin-containing substrate with effective amounts of (a) a water soluble resin component having available chelate bond-forming chemical groups and (b) a nontoxic metal salt of an element selected from the group consisting of zinc, magnesium aluminum, sodium, calcium and potassium; said resin component forming a chelate bond with chelate bond-forming groups of said water soluble resin component; and (B) completing fabrication of the desired filter element.

2. A method of claim 1 wherein treatment of said substrate is effected before formation of a filter plug.

3. A cigarette filter element obtained in accordance with claim 2.

4. A method of claim 1 wherein treatment of said substrate is effected after formation of a wrapped filter plug.

5. A cigarette filter element obtained in accordance with claim 4.

6. A method of claim 1, wherein solutions of said water soluble resin component and said nontoxic water soluble nontoxic metal salt component are applied, in sequence, to a polyolefin-containing substrate.

7. A cigarette filter element obtained in accordance with claim 6.

8. A method of claim 1, wherein aqueous solutions of said water soluble resin component and water soluble nontoxic metal salt component are combined and simultaneously applied to a polyolefin-containing substrate.

9. A cigarette filter element obtained in accordance with claim 8.

10. A method of claim 1, wherein the substrate is a polyolefin-containing substrate pretreated with maleic anhydride.

11. A cigarette filter element obtained in accordance with claim 10.

12. A method of claim 1, wherein the water soluble resin component is a polyethyleneimine.

13. A cigarette filter element obtained in accordance with claim 12.

14. A method of claim 1, wherein the water soluble resin component is a linear polyamide-epichlorohydrin condensate.

15. A cigarette filter element obtained in accordance with claim 14.

16. A method of claim 1, wherein the water soluble resin component is a polythiol.

17. A cigarette filter element obtained in accordance with claim 16.

18. A method of claim 1, wherein the water soluble resin component is a polycarboxylate.

19. A cigarette filter element obtained in accordance with claim 18.

20. A method of claim 1, wherein the resin component is a polyether.

21. A cigarette filter element obtained in accordance with claim 20.

22. A method of claim 1, wherein the water soluble resin component is polyethyleneimine, and the nontoxic water-soluble salt is zinc thiocyanate.

23. A cigarette filter element obtained in accordance with claim 22.

24. A cigarette filter element obtained in accordance with claim 1.

25. A method of claim 1, wherein the nontoxic salt is a water soluble salt of zinc.

* * * * *

UNITED STATES PATENT AND TRADEMARK OFFICE

CERTIFICATE OF CORRECTION

PATENT NO. : 4,907,609

DATED : MARCH 13, 1990

INVENTOR(S) : COHEN & MCCARTY

It is certified that error appears in the above-identified patent and that said Letters Patent is hereby corrected as shown below:

Column 1, Line 64, " mounts "

should read -- amounts --

Column 4, Line 21, " et., "

should read -- etc., --

Column 4, Line 22, " and " (first occurrence)

should read -- such --

Signed and Sealed this

Twentieth Day of August, 1991

*Attest:*

*Attesting Officer*

HARRY F. MANBECK, JR.

*Commissioner of Patents and Trademarks*